US005237734A

United States Patent [19]

Polon

[11] Patent Number: 5,237,734

[45] Date of Patent: Aug. 24, 1993

[54] METHOD OF INTERLOCKING HEMMED TOGETHER PANELS

[75] Inventor: Mario A. Polon, Shelby, Mich.

[73] Assignee: General Motors Corporation, Detroit, Mich.

[21] Appl. No.: 888,392

[22] Filed: May 15, 1992

Related U.S. Application Data

[63] Continuation of Ser. No. 678,404, Apr. 1, 1991, abandoned.

[51] Int. Cl.[5] ..... B21D 39/02

[52] U.S. Cl. ..... 29/513; 29/243.58; 29/509; 29/521

[58] Field of Search ..... 29/243.5, 243.57, 243.58, 29/505, 509, 521, 897.2, 897.3, 897.32, 897.312, 513, 514; 72/321; 52/60, 455, 588; 296/29, 76

[56] References Cited

U.S. PATENT DOCUMENTS

| | | | |
|---|---|---|---|
| 2,642,111 | 6/1953 | Bindszus | 29/243.58 |
| 3,824,757 | 7/1974 | Coop | 29/521 X |
| 3,861,339 | 1/1975 | Aida et al. | 29/521 X |
| 3,862,490 | 1/1975 | Tsuneishi et al. | 29/521 X |
| 3,883,940 | 5/1975 | Wagner | 29/243.58 |
| 3,909,918 | 10/1975 | Takizawa et al. | 29/521 X |
| 3,909,919 | 10/1975 | Miyabayashi et al. | 29/521 |
| 4,510,660 | 4/1985 | Hoeffken | 29/514 |
| 4,891,912 | 2/1990 | Slasinski | 29/521 X |

FOREIGN PATENT DOCUMENTS

| | | | |
|---|---|---|---|
| 280929 | 11/1990 | Japan | 29/513 |

OTHER PUBLICATIONS

Greenwood "Assembly Method" Product Engineering, Jun. 8, 1959, pp. 91-104.

*Primary Examiner*—Mark Rosenbaum
*Assistant Examiner*—Peter Dungba Vo
*Attorney, Agent, or Firm*—Charles E. Leahy

[57] ABSTRACT

A method for interlocking the hemmed together flanges of the inner and outer panels comprises the steps of forming a plurality of raised beads at spaced intervals along the length of the edge of the inner panel; placing the inner panel inside the outer panel with the raised beads facing away from the outer panel; and hemming the edge of the outer panel over the edge of the inner panel by a hemming punch having a plurality of slots therein located to register with the raised beads of the inner panel so that the outer panel is coined into interlocking engagement with the raised beads to thereby interlock the inner and outer panels together against relative movement. The raised beads preferably have a height generally equal to the thickness of the inner panel, and are preferably elongated in shape with the elongation extending in the direction either parallel or perpendicular to the edge of the panel. The slots in the hemming die preferably have a length longer than the mating raised bead of the inner panel to allow at least one millimeter of clearance between the panels at each end of the beads.

7 Claims, 3 Drawing Sheets

METHOD OF INTERLOCKING HEMMED TOGETHER PANELS

This is a continuation of application Ser. No. 07/678404 filed on Apr. 1, 1991 now abandoned.

The invention relates to a method of hem flanging the edges of motor vehicle panels and more particularly provides a method for interlocking the hemmed together panels against relative movement.

BACKGROUND OF THE INVENTION

It is well known to construct vehicle body door, hoods, and deck lids by stamping an outer panel and an inner panel which are joined together by flanging the edges of the outer panel over the edge of the inner panel. The inner and outer panels are individually stamped to their desired size and shape, with the outer panel being slightly larger than the inner panel to provide an edge portion along the edge of the outer panel which can be folded over the edge of the inner panel to define the hem flange which connects the two panels.

It has been recognized in the prior art that this hem flanging together of the panels may not be sufficient to prevent the inner panel from sliding relative to the outer panel. Accordingly, it has been known to employ auxiliary attachment techniques to lock the panels against relative movement For example, it has been known to apply an arc, mig, or fusion weld to tack the hemmed over edge of the outer panel to the inner panel. It is also known to spot weld the two panels together at the flange. In still other situations, induction heat has been used to cure the adhesive previously applied between the panels at the area of the flange. In each of these cases, these operations requires additional equipment and labor and inevitably damages or distorts the assembled panels which in turn require refinishing of the metal to correct the imperfections which will become visible when the outer panel is painted.

It has also been known to provide a hole in the edge of the inner panel and to provide a corresponding projection on the face of the hem flanging punch so that the punch which flanges the outer panel over the inner panel will also press the flange into the hole in the inner panel. Although this technique eliminates the additional investment and labor of a welding operation, it nonetheless has been found to distort the outer panel because the hole in the inner panel reads through the outer panel.

It would therefore be desirable to provide an improved method for interlocking together the inner and outer panels of a hemmed flange motor vehicle closure panel.

According to the present invention, the method of interlocking the hemmed together flanges of the inner and outer panels comprises the steps of forming a plurality of raised beads at spaced intervals along the length of the edge of the inner panel; placing the inner panel inside the outer panel with the raised beads facing away from the outer panel; and hemming the edge of the outer panel over the edge of the inner panel by a hemming punch having a plurality of slots therein located to register with the raised beads of the inner panel so that the outer panel is coined into interlocking engagement with the raised beads to thereby interlock the inner and outer panels together against relative movement. The raised beads preferably have a height at least equal to the thickness of the inner panel, and are preferably elongated in shape with the elongation extending in the direction either parallel or perpendicular to the edge of the panel. The slots in the hemming die preferably have a length longer than the mating raised bead of the inner panel to allow at least one millimeter of clearance between the panels at each end of the beads.

BRIEF DESCRIPTION OF THE DRAWINGS

These and other objects, features and advantages of the invention will become apparent upon consideration of the description of the preferred embodiment and the appended drawings.

DESCRIPTION OF THE PREFERRED EMBODIMENT

Figure 1:
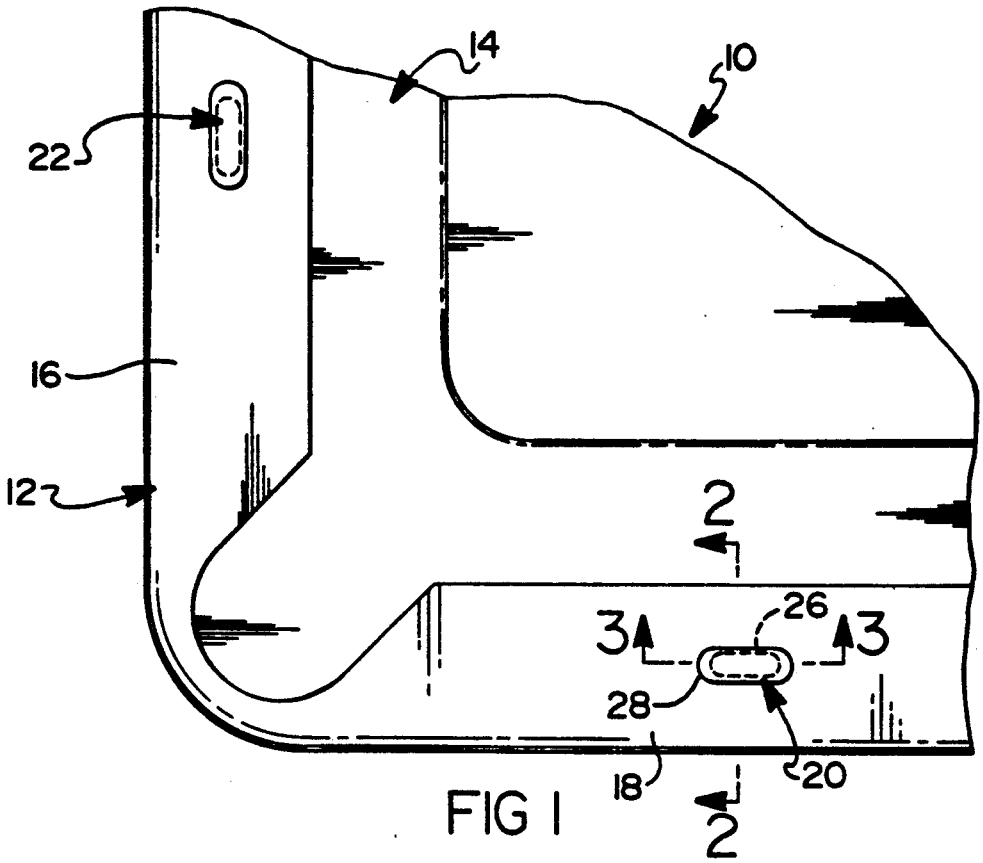
FIG. 1 is a plan view showing inner and outer panels which have been hemmed flanged together according to the method of the present invention.

FIG. 1 shows the inside rear lower corner of a vehicle door 10 which is comprised of an outer panel 12 and an inner panel 14. The outer panel 12 has a flange 16 along the rear thereof and a flange 18 along the bottom thereof which respectively overlie the rear and bottom edges of the inner panel 14 so that the outer panel 12 and inner panel 14 are connected together. An interlock 20 located along the bottom edge of the door and an interlock 22 located along the rear edge of the door act between the inner and outer panels to prevent relative movement therebetween which might be permitted by slippage of the inner panel inside the flanges of the outer panel.

Figure 2:
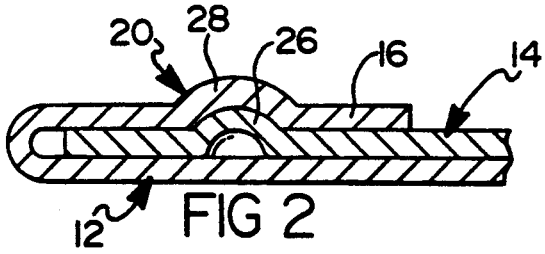
FIG. 2 is a section view taken in the direction of arrows 2—2 of FIG. 1.
Figure 3:
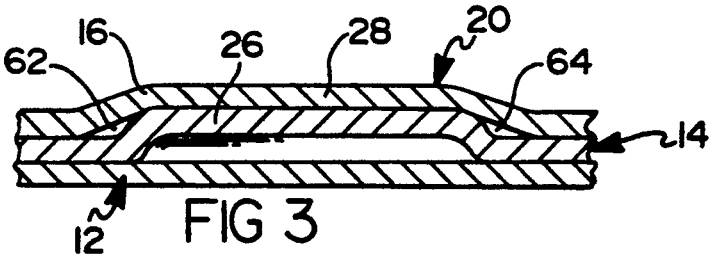
FIG. 3 is a section view taken in the direction of arrows 3—3 of FIG. 1.

FIGS. 2 and 3 show the construction of the interlock 20. In particular, it is seen that the inner panel 14 carries raised bead 26 which has a elongated shape and extends in a direction parallel to the edge of the panels. The height of the raised bead 26 is at least equal to the thickness of the sheet metal, typically in the range between 0.70 to 1.00 millimeters. The flange 16 of the outer panel 12 overlies the inner panel 14 and is formed to closely fit around and engage the raised bead 26 of the inner panel and thereby define a raised bead 28 on the flange 16. Upon reference to FIG. 2 it will appreciated that the interlock provided by the engagement between the raised bead 26 and the overlying bead 28 will be effective to prevent the inner panel 14 from sliding inside the flange structure defined by the flange 16.

FIGS. 5*a*, 5*b*, 5*c* and 5*d* show the method by which the interlock of FIGS. 1, 2 and 3 is provided.

Figure 5A:
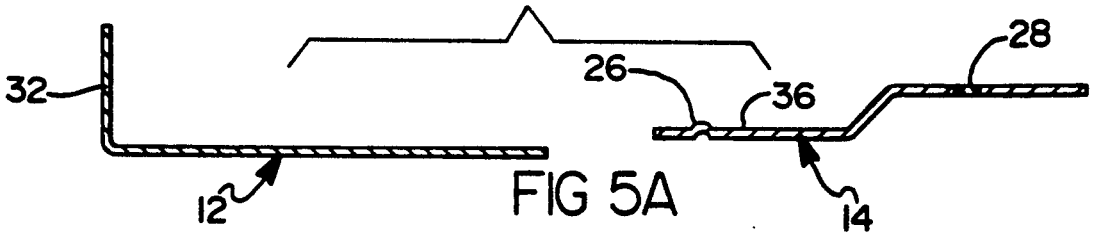
FIG. 5*a* shows the inner and outer panels prior to being married together.

FIG. 5*a* shows that the outer panel 12 and the inner panel 14 will be separately stamped. The outer panel 12 is stamped using conventional processes and is sized to provide a flange forming lip 32 along the edge thereof which is bent to assume an upstanding position, preferably 90 degrees from the plane of the outer panel 12. The inner panel 14 is formed in the desired shape which will reinforce the outer panel 12 and has an edge portion 36 which will become engaged by the flange lip portion 32 of the outer panel 12 during a subsequent flanging operation. This edge portion 36 of the inner panel 14 is formed to include the raised beads 26 at spaced intervals therealong as well as one or more locating holes 28.

Figure 5B:
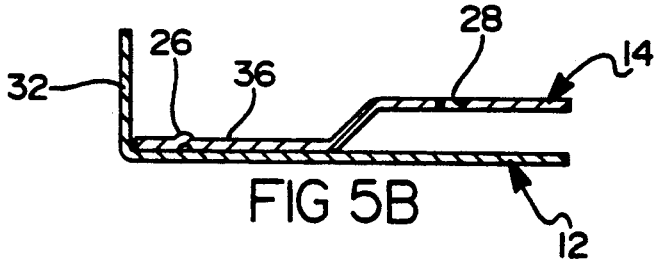
FIG. 5*b* shows the inner and outer panels married together.

FIG. 5*b* shows the inner panel 14 married to the outer panel 12 with the raised bead 26 projecting away from the outer panel 12.

Figure 5C:
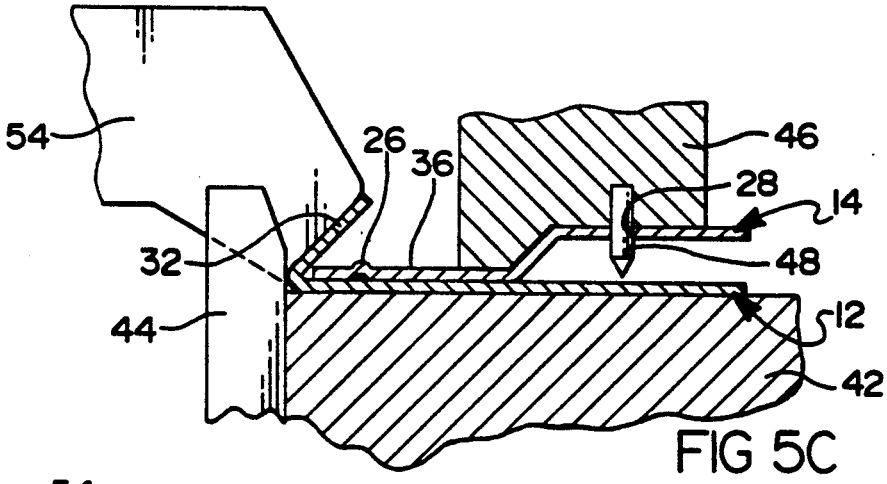
FIG. 5*c* shows the hem flanging of the outer panel over the inner panel.

FIG. 5*c* shows the married panels 12 and 14 installed in a flanging press. The outer panel 12 rests upon a platen 42 having a guide rail 44 along the edge thereof which engages the flange forming portion 32 to hold the outer panel 12 against movement. A retaining pad 46 is lowered onto the inner panel 14 and carries a plurality of locator pins 48 which extend through the locating pin holes 28 of the inner panel 14 to accurately locate and hold the inner panel 14 at the desired position relative the outer panel 12. Then, a flange die 54 is rotated inwardly to push the flange forming portion 32 of the outer panel 12 from the upstanding position of FIG. 5*a* to the angled position of FIG. 5*c*.

Figure 5D:
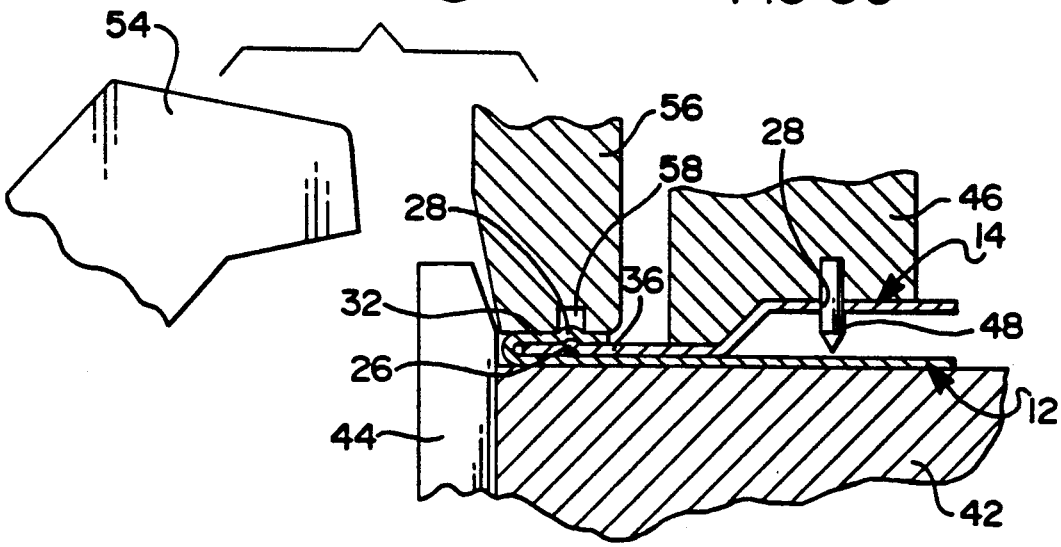
FIG. 5*d* shows the final hem flanging of the outer panel flange onto the inner panel.

Then, as seen in FIG. 5*d*, the flange die 54 is withdrawn and a punch 56 is lowered to press the flange forming portion 32 onto the edge portion 36 of the inner panel 14. This lowering of the punch 56 continues to force the flange forming portion 32 into flange forming engagement with the inner panel to determine the flange 16 as shown in FIGS. 1, 2, and 3. The punch 56 has a elongated slot 58 formed therein which registers with the raised bead 26 of the inner panel 14 and thereby causes the flange 16 to be coined or formed over the raised bead 26. In this manner the flange 16 is caused to have a raised bead 28 which engages and closely surrounds the raised bead 26 to interlock the panels together as shown in FIGS. 1, 2, and 3.

As best seen in FIG. 3, the raised bead 28 is preferably oversized somewhat in length with respect to the raised bead 26 so that gaps 62 and 64 are provided at the ends of the beads. As best seen in FIG. 1, it will be understood that the interlock 20 at the lower edge of the door will prevent the inner panel 14 from moving vertically up and down relative the outer panel 12, while the interlock 22 at the trailing of the door will prevent the inner panel 14 from sliding fore and aft relative the outer panel 12.

Figure 4:
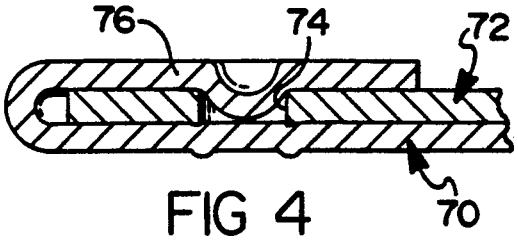
FIG 4 PRIOR ART
FIG. 4 shows a section similar to FIG. 2 in which the prior art method has been employed to interlock the edges of the inner and outer flanges.

FIG. 4 shows the prior art method for interlocking an outer panel 70 and an inner panel 72. In this method the inner panel 72 is provided with an aperture 74 so that flanging the flange forming portion 76 of the outer panel onto the inner panel will permit the flange to be pressed downwardly into the aperture to thereby interlock the panels. The present invention has been found to provide a superior interlock over the prior art method of FIG. 4. In particular, in comparing FIGS. 2 and 4, it will be seen that the method of the present invention 2 causes a closer fitting surface-to-surface inter-engagement between the raised beads 26 and 28 of the inner and outer panels as opposed to the lesser area of contact provided in FIG. 4. Furthermore, it has been found that the method accomplishing the flange of FIG. 2 does not cause any distortion or read through onto the outer finished surface of the outer panel 12.

Figure 6:
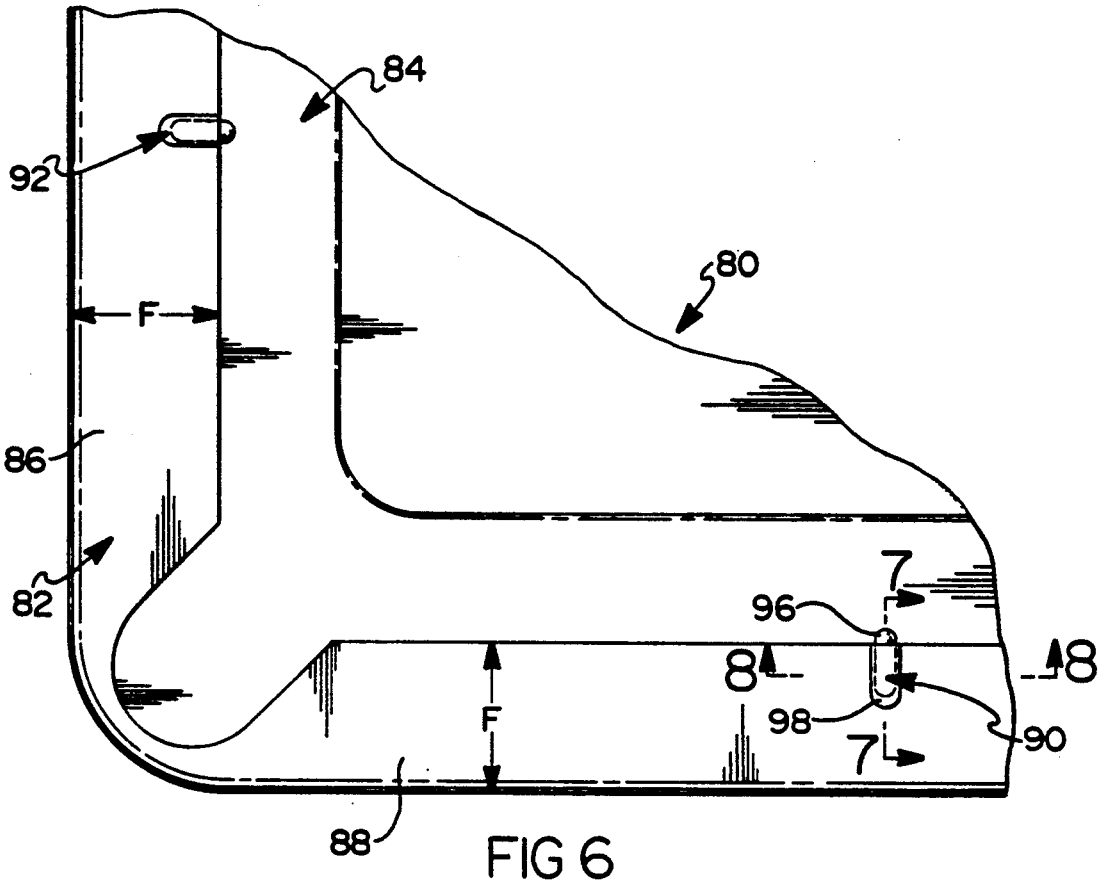
FIG. 6 is a plan view of a second embodiment of the invention showing the inner and outer panels hem flanged together.

FIG. 6 shows a second embodiment of the invention in which the inside rear lower corner of a vehicle door 80 is comprised of an outer panel 82 and an inner panel 84. The outer panel 82 has a flange 86 along the rear thereof and a flange 88 along the bottom thereof which respectively overlie the rear and bottom edges of the inner panel 84 so that the outer panel 82 and the inner panel 84 are connected. An interlock 90 located along the bottom edge of the door and an interlock 92 located along the rear edge of the door act between the inner and outer panels to prevent relative movement therebetween.

Figure 7:
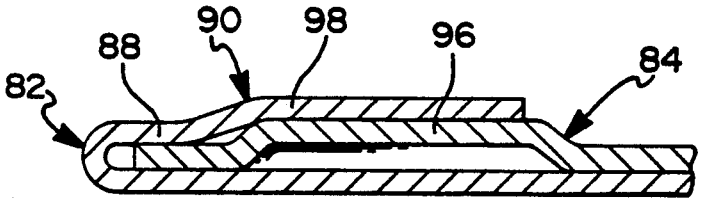
FIG. 7 is a section view taken in the direction of arrows 7—7 of FIG. 6.
Figure 8:
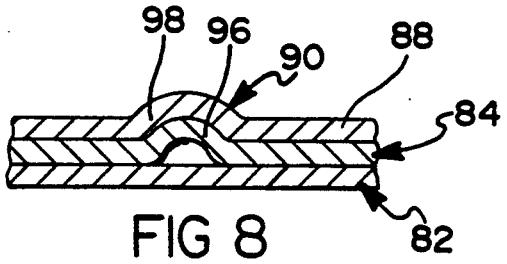
FIG. 8 is a section view taken in the direction of arrows 8—8 of FIG. 6.

FIGS. 7 and 8 shows the construction of the interlock 90. In particular it is seen that the inner panel 84 carries raised bead 96 which has an elongated shape and extends in a direction perpendicular to the edge of the panels. The flange 88 of the outer panel 82 overlies the inner panel 84 and is formed to closely fit around and engage the raised bead 96 of the inner panel and thereby define a raised bead 98 on the flange 88.

As best seen in FIG. 6, the flange has a width designated F and the interlock 90 is located on the panels such that, as best shown in FIG. 7, the raised bead 98 stops short of completely overlying raised bead 96. Nonetheless, the interlock 90 will be sufficient to prevent the fore and aft relative movement between the panels. The interlock 92 is constructed similar to the interlock 90 and will prevent relative vertical motion between the outer panel 82 and the inner panel 84.

It will be understood that the customary sealants or adhesives may be applied between the inner and outer panels in conjunction with the forming process described herein.

Thus it is seen that the invention provides a new and improved method for interlocking hemmed flanged together inner and outer panels defining vehicle body closures such as hoods, deck lids, door, tail gates, hatches, etc.

The embodiments of the invention in which an exclusive property or privilege is claimed are defined as follows:

1. A method of interlocking hemmed together edges of inner and outer panels and preventing disortion of the outer panel, comprising the steps of:

forming a plurality of raised beads at spaced intervals along the edge of only the inner panel;

placing the outer panel on a flat platen;

placing the inner panel inside the outer panel with the raised beads facing away from the outer panel;

and hemming the edge of the outer panel over the edge of the inner panel by hemming punch means having a plurality of slots therein located to register with the raised beads of the inner panel so that the edge of the outer panel is coined into interlocking engagement with the raised beads of the inner panel and forms a raised bead on the outer panel which overlies and closely fits around the raised bead of the inner panel to thereby interlock the inner and outer panels together against relative movement.

2. The method of claim 1 further characterized by the raised bead having a height, and the inner panel having a thickness, and the height of the raised bead being generally equal to the thickness of the inner panel.

3. The method of claim 1 further characterized by the raised bead being elongated to provide an elongated shape extending in a direction parallel with edge of the panel.

4. The method of claim 1 further characterized by the raised bead being elongated in shape with the elongation extending in a direction perpendicular to the edge of the panel.

5. The method of claim 1 further characterized by only a portion of the edge of the outer panel being hemmed over the raised bead of the inner panel.

6. The method of claim 3 further characterized by the hemming being performed by a hemming die having slots and the slots in the hemming die having a length longer than the raised bead of the inner panel to allow about 1 millimeter of clearance between the panels at each end of the raised beads.

7. A method of interlocking hemmed together edges of inner and outer panels and preventing distortion of the outer panel, comprising the steps of:

stamping the inner panel to a desired size and shape including forming a plurality of raised beads at spaced intervals along the edge of the inner panel;

stamping the outer panel to a desired size and shape with the outer panel having a flange forming edge portion adapted to be hemmed over the edge of the inner panel to hem flange the panels together;

placing the outer panel on a flat platen;

marrying the inner and outer panel by placing the inner panel inside the outer panel with the raised beads facing away from the outer panel and with fixtures which hold the panels against movement relative one another;

and hemming the edge of the outer panel over the edge of the inner panel by hemming punch means having a plurality of slots therein located to register with the raised beads of the inner panel so that the edge of the outer panel is coined into interlocking engagement with the raised beads of the inner panel and forms a raised bead on the outer panel which overlies and closely fits around the raised bead of the inner panel of the inner panel to thereby interlock the inner and outer panels together against relative movement.

* * * * *